United States Patent [19]

Eustis

[11] 3,990,260

[45] Nov. 9, 1976

[54] LOW-TEMPERATURE DEHUMIDIFIER

[76] Inventor: William E. C. Eustis, 1452 Canton Ave., Milton, Mass. 02186

[22] Filed: Apr. 4, 1975

[21] Appl. No.: 565,212

[52] U.S. Cl. ..... 62/89; 62/235

[51] Int. Cl.[2] ..... F25D 17/06; A63C 19/10

[58] Field of Search ..... 62/89, 235, 93

[56] References Cited

UNITED STATES PATENTS

| | | | |
|---|---|---|---|
| 2,225,207 | 12/1940 | Cluff | 62/235 |
| 2,475,077 | 7/1949 | Clancy | 62/89 |
| 3,071,934 | 1/1963 | Joyner | 62/89 |
| 3,464,224 | 9/1969 | Swanson | 62/89 |
| 3,641,782 | 2/1972 | Timms | 62/235 |
| 3,658,124 | 4/1972 | Tippmann | 62/235 |

*Primary Examiner*—Lloyd L. King

*Attorney, Agent, or Firm*—Richard L. Stevens

[57] ABSTRACT

A low temperature dehumidifier wherein a high pressure fan removes air from an enclosed skating rink. The fan discharges the air into and through an air-conditioning unit. The use of the fan results in a positive pressure in the air-conditioner upstream of the cooling coil. The pressure increases the temperature of the air; moisture is removed when the air contacts the cooling coil, but ice formation on the coil is prevented. The air is discharged on the downstream side of the coil and experiences a pressure drop, further cooling the air which is returned to the skating rink.

6 Claims, 1 Drawing Figure

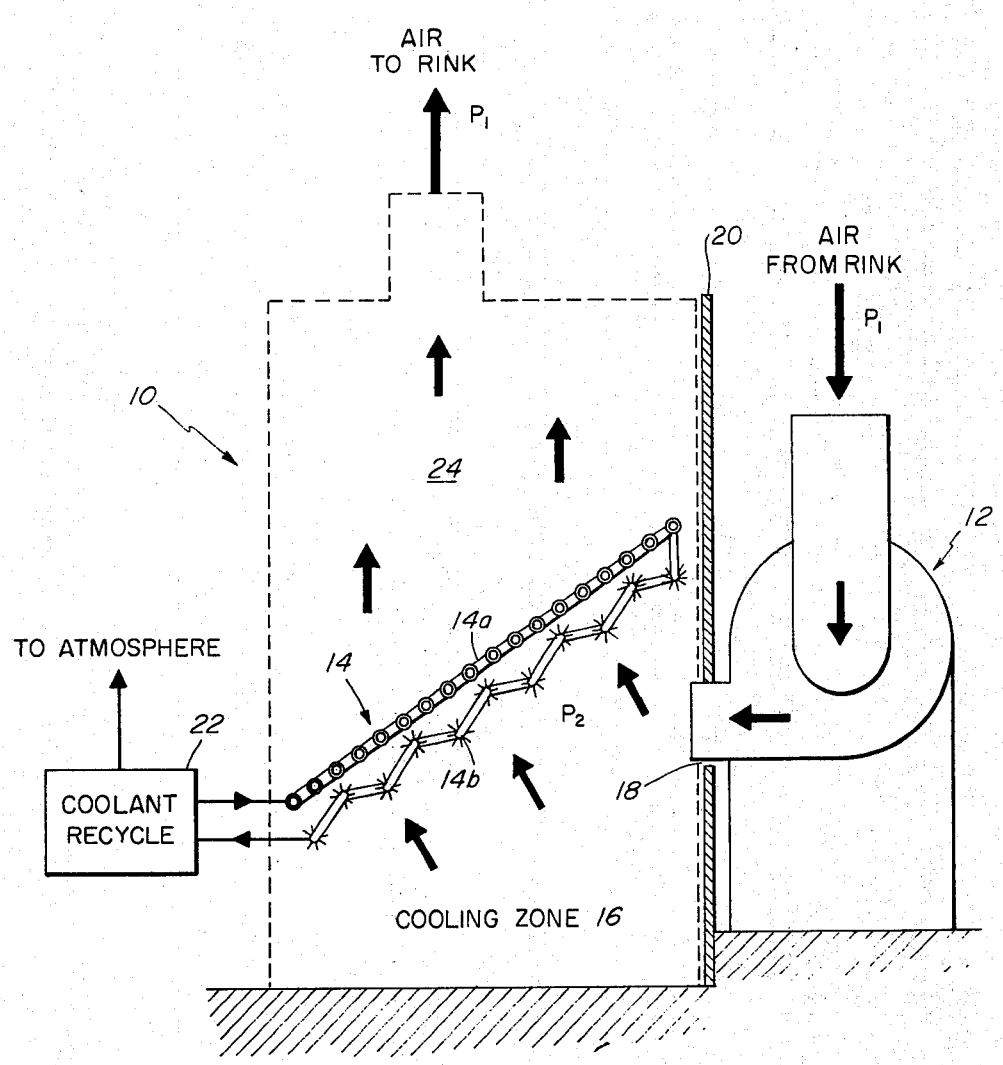
AIR
TO RINK
$P_1$
20
AIR
FROM RINK
$P_1$
10
24
12
14a
TO ATMOSPHERE
14
22
$P_2$
14b
18
COOLANT
RECYCLE
COOLING ZONE 16

LOW-TEMPERATURE DEHUMIDIFIER

BACKGROUND OF THE INVENTION

The season for operation of enclosed ice-skating rinks has been increasing the last few years such that the ice surfaces are maintained on a yearly basis or for a ten-month period excluding July and August. In many geographical areas in the spring, summer, and early fall months, high humidity conditions are encountered during the day. When the temperature drops at night, large quantities of moisture are condensed on the colder inner surfaces of the structure, such as the ceiling and ceiling beams resulting in corrosion. This requires time-consuming and costly maintenance procedures.

Attempts to overcome this problem have employed large-scale refrigeration or air-conditioning units. However, the use of a single unit has not proven satisfactory since the coil carrying the refrigerant would eventually ice up on its outer surfaces and the refrigeration unit would have to be shut down to allow the ice to melt off. Alternate refrigeration units have been considered, but this is a costly procedure. The use of air dehydrators is not feasible because of the cost and large volume of air to be handled.

The present invention is directed to a method and apparatus for inhibiting the formation of ice on the heat-exchange surfaces of an air-conditioning unit. The invention in one embodiment is directed to a method and apparatus for preventing the formation of ice on the cooling coil in a heat-exchange unit, which unit conditions an airstream by removing a portion of its moisture (water) content.

In the preferred embodiment of my invention, a cooling coil is disposed in a zone, which zone is maintained at a pressure higher than the pressure of the air introduced into the zone. This increased pressure raises the temperature of the air relative to its inlet temperature and also lowers the freezing point of the entrained moisture. The surface of the cooling coil is less than the dew point temperature of the airstream in the zone and more than the temperature at which the condensed moisture would exhibit a phase change from liquid (water) to solid (ice).

Stated otherwise, the coil surface temperatures are at a temperature lower than that of the air in the zone but still at a temperature above that at which ice would form and below the dew point temperature of the air contacting said surfaces. The air contacts the heat-exchange surface, is cooled, and moisture is condensed therefrom. The air is subsequently removed from the zone and experiences a pressure drop which lowers its temperature. In this application, dew point temperature is considered the temperature at which air is saturated with moisture.

BRIEF DESCRIPTION OF THE DRAWING

The drawing is a schematic illustration partly broken away of an apparatus employed in a method of my invention.

DESCRIPTION OF THE PREFERRED EMBODIMENT

An apparatus representing one embodiment of the invention is shown in the drawing and comprises a standard air-conditioning unit 10 such as a York 5-ton air conditioner. Directly upstream of the inlet side of the air-conditioner is a high-pressure fan 12 such as a Dalton belt-driven blower Model No. 7C186.

The air-conditioning unit 10 shown in the drawing is a standard commercial unit. Such units are of a generally rectangular cross-section having a bottom, four walls and a top. An inlet aperature is formed on one wall, and an outlet aperture on the top. Within the air-conditioning unit is a fan to draw air into and through the unit; a compressor, pump and cooling unit for the refrigerant; and a cooling coil generally arranged at a 45° angle in reference to the horizontal, through which the air to be conditioned flows.

The floor and walls of the conditioner 10 in combination with a cooling coil 14 generally define a cooling zone 16 or chamber to confine and direct the flow of air to and across the cooling coil 14. In the present invention, the high-pressure fan 12 is received in an inlet aperture 18. For the specific fan employed, the discharge end of the fan is smaller than the aperture 18 on the air-conditioning machine 10. Accordingly, a panel 20 is secured to the air-conditioner and the discharge end of the fan 12 in a seal-tight manner. This insures that within the zone defined by the floor, walls, and cooling coil 14 of the air-conditioning unit 10 a positive pressure will be maintained when the fan is operating.

The cooling coil 14 comprises the standard cooling coil **14*a* having an extended surface of fins with a serially connected cooling soil 14*b* added thereto such as by welding. The heat-exchange surface of the unit 10 is approximately doubled by adding the coil 14*b*, which coil has an extended surface and includes a pluralityy of finger-like projections. If desired, an additional cooling coil exactly as found in the air-conditioning unit 10** may be used, or any combination of various heat-exchangers.

The compressor pump and cooling unit 22 for the refrigerant in the preferred embodiment and as shown in the drawing are secured external to the unit 10. This is done to maximize the efficiency of the process and to facilitate the venting of the heat from the unit 22 to the atmosphere and external of the skating rink. If desired, the unit 22 may remain within the unit 10 as commercially provided.

In the operation of the invention, the unit 10 is actuated and any suitable refrigerant, such as a halogenated hydrocarbon, particularly a fluorocarbon, for example Freon 12 flows through the serially connected coils **14*a*** and *b*. The fan 12 is actuated and rotates at approximately 3600 rpm. The fan 12 provides positive pressure in the cooling zone 18 of approximately 4 inches of water, which pressure is maintained by the continuous flow of air created by the fan. Air at a first lower temperature between about 34°–60° F., say for example 50° F., and at a wet bulb temperature of 49° F. and at atmospheric pressure $P_1$ is drawn by the fan 12 from an enclosed area, i.e., a skating rink, into the zone 18 at a rate of 3000 cfm. The refrigerant enters the coil **14*a* at approximately 10° F. and is discharged from the coil 14*b* at approximately 25° F. The temperature of the air in the zone 18 is raised to a second higher temperature due to the increase in pressure $P_2$ by between 3°–10° F., say for example 7° F. to 57° F. The air at the second higher temperature and pressure $P_2$ flows across the coil 14 into a discharge zone 24. The heat-exchange surfaces of the coil 14 are between 10°–25° F. inlet to outlet temperature and up to 2.5 ounces per minute of water are condensed as the air contacts the heat-exchange surfaces and falls below its dew point temperature. The condensate is removed from the heat-exchange surfaces over the fins of coil 14***a* and the pins of coil 14*b*.

The air entering the zone 24 is reduced in pressure to atmospheric $P_1$ and cools to a third temperature lower than the first temperature between about 26°–55°F., say for example 45° F. at which temperature and pressure it is discharged into the enclosed area or skating rink. The air discharged into the skating rink thus is cooled by the heat-exchange which the coil 14 and the pressure drop as it enters the zone 24. Ice is prevented from forming on the cooling coil by the increase in temperature in the zone 16.

Therefore, the present invention provides a method and apparatus for low-temperature dehumidification of air wherein the formation of ice on a cooling coil is prevented. The following examples were conducted using the apparatus as described above. In each example, when the high pressure fan 12 was shut off and the standard fan used, that is, no positive pressure in the chamber 16, ice commenced to form on the coil 14.

EXAMPLE I

Air from the skating rink, temperature 51° F., wet bulb temperature 49° F., was introduced into the chamber 16. The temperature of the air was raised to 58° F. in the chamber, at a pressure of 4 inches of water. The air in the chamber 24 was reduced to atmospheric pressure and returned to the skating rink at 45° F. 2.5 ounces of water per minute were collected.

EXAMPLE II

Air from the skating rink, temperature 37°40F., was introduced into the chamber 16. The temperature of the air was raised to 47° F. The air in the chamber 24 was reduced to atmospheric pressure and returned to the skating rink at 28° F.

Although my invention has been described with reference to a specific apparatus and method, it is obvious other types of heat-exchange surfaces may be used to cool the airstream and to remove water therefrom. Also, the chamber 16 may be pressurized by means other than a high pressure fan. Further, the temperatures and flow rates illustratively set forth above will vary depending upon dew point, wet bulb temperatures and inlet temperature of the airstream which is to be conditioned.

Having described my invention what I now claim is:

1. A method for the low-temperature dehumidification which includes:

a. introducing an airstream having moisture therein at a first lower temperature and pressure into a cooling zone;

b. inhibiting the accumulation of solid material on a heat exchange surface by:

i. maintaining the zone, which zone is in heat-exchange relationship with the surface, at a second pressure higher than the first pressure and increasing the temperature of the airstream in the zone to a second higher temperature at said second higher pressure to prevent a phase change of removed moisture from liquid to solid; and ii. placing the airstream in the cooling zone in contact with the heat-exchange surface to remove heat therefrom and to condense at least a portion of the moisture from the airstream; and c. discharging the air into an enclosed area at a third temperature lower than the first temperature.

2. The method of claim 1 which includes maintaining the temperature of the heat-exchange surface at a temperature less than the dew point temperature of the airstream.

3. The method of claim 1 which includes discharging the airstream from the cooling zone at a pressure substantially equal to the pressure at which the airstream is introduced into the cooling zone whereby the airstream is further cooled.

4. The method of claim 1 wherein the airstream is introduced at a temperature of between about 34°–60° F. and atmospheric pressure;

the temperature of the airstream in the cooling zone is raised to between about 3°–10° F. and at a pressure of between 2–8 inches of water; and the discharge temperature of the airstream is between 26°–55° F. and substantially at atmospheric pressure.

5. The method of claim 1 which includes maintaining the pressure in the zone by flowing continuously the airstream into the zone at a rate sufficient to maintain said pressure.

6. An apparatus for conditioning the air of an enclosed area which comprises in combination:

a. a refrigeration unit including a cooling zone;

b. means to introduce an airstream into the cooling zone at a rate sufficient to increase the pressure in the cooling zone whereby the temperature of the airstream in the cooling zone is raised;

c. means to confine the airstream introduced to maintain the pressure increase in the cooling zone which means includes at least a heat-exchange surface which surface defines in part the cooling zone and which heat-exchange surface removes the heat from the airstream and reduces the temperature of the airstream below its dew point temperature to remove moisture therefrom; and d. means to discharge the airstream from the cooling zone at a pressure substantially equal to the inlet pressure.

* * * * *